US006036380A

United States Patent [19]

Astroth et al.

[11] Patent Number: 6,036,380

[45] Date of Patent: Mar. 14, 2000

[54] PRINTER HAVING A PLASTIC PLATEN

[75] Inventors: Dennis J. Astroth, Poway; Gary Graham; Scott D. Slade, both of San Diego; Barry Schwartz, La Mesa; Truong Nguyen, El Cajon; Linda Schott; Don Spann, both of San Diego, all of Calif.

[73] Assignee: ENCAD, Inc., San Diego, Calif.

[21] Appl. No.: 09/025,973

[22] Filed: Feb. 19, 1998

Related U.S. Application Data

[60] Provisional application No. 60/038,673, Feb. 20, 1997.

[51] Int. Cl.[7] ..... B41J 3/28

[52] U.S. Cl. ..... 400/23; 400/48; 400/656; 400/662

[58] Field of Search ..... 400/23, 41, 48, 400/648, 649, 652, 654, 655, 656, 657, 658, 661.2, 662, 24–33; 101/474, 407.1, 382.1, 287, 288, 93

[56] References Cited

U.S. PATENT DOCUMENTS

| | | | |
|---|---|---|---|
| 2,050,993 | 8/1936 | Bush | 101/384 |
| 3,480,127 | 11/1969 | Hesse et al. | 400/662 |
| 4,120,245 | 10/1978 | Karp et al. | 400/48 |
| 4,318,452 | 3/1982 | Reitner | 400/656 |
| 4,411,197 | 10/1983 | Sato | 101/474 |
| 4,489,651 | 12/1984 | De Luca et al. | 400/48 |
| 4,676,683 | 6/1987 | Uchikata et al. | 400/656 |
| 4,872,521 | 10/1989 | Abellana et al. | 400/33 |
| 4,957,382 | 9/1990 | Delaney et al. | 400/645 |
| 5,090,825 | 2/1992 | Merriman, Jr. et al. | 400/649 |
| 5,863,146 | 1/1999 | DeMarchi | 400/23 |

FOREIGN PATENT DOCUMENTS

| | | | |
|---|---|---|---|
| 0013579 | 1/1985 | Japan | 400/654 |
| 0048385 | 3/1985 | Japan | 400/662 |
| 0304970 | 12/1989 | Japan | 400/656 |
| 403128263 | 5/1991 | Japan | 400/649 |

OTHER PUBLICATIONS

"Hammer Flight Time Transducer Mounted to Printing Platen" IBM Tech. Discl. Bulletin pp 4909–10 vol. 27, No. 8, Jan. 1985.

"Printer Platen for Band Printer" IBM Tech. Discl. Bulletin, vol. 25, No. 7A p 3521, Dec. 1982.

"Plastic Document Holder". IBM Tech. Discl. Bulletin, vol. 19, No. 9, p 3465, Feb. 1977.

*Primary Examiner*—Eugene Eickholt

*Attorney, Agent, or Firm*—Knobbe, Martens, Olson & Bear, LLP

[57] ABSTRACT

An inkjet printer includes a plastic platen and a structural member extending upward from the base of the printer. The printing surface is supported by the upper surface of the structural member. This surface is held flat to within very tight tolerances. The bottom of the platen printing surface is retained against this surface so that it conforms to the shape of this surface structural member to create a substantially flat printing surface.

27 Claims, 3 Drawing Sheets

PRINTER HAVING A PLASTIC PLATEN

PRIORITY CLAIM

This application claims priority under 35 U.S.C. § 119(e) to U.S. Provisional Application Ser. No. 60/038,673 filed Feb. 20, 1997, entitled "Wide Format Ink Jet Printer Having a Plastic Platen." Furthermore, is hereby incorporated by reference in its entirety.

BACKGROUND

The printer industry has engaged in a continuing effort to provide high quality, printing at affordable prices. Such printers include color or black-and-white printing on substrates such as paper or textile in standard or wide format. Such high quality, dependable devices have tended to be extremely expensive especially in the inkjet printer industry.

High quality inkjet printing has usually depended upon a number of factors well known to one of ordinary skill in the art. Such factors include, but are not limited to, knowledge about the accuracy and appropriateness of certain inks and certain ink colors upon certain substrates in a myriad of environments for a host of applications. Further, assuming the proper ink and substrate are chosen for the proper application in the chosen environment, the inkjet printer also requires a carefully manufactured platen including an extremely flat printing surface.

A well manufactured platen includes a printing surface parallel with a print head comprising a jet plate which moves along a guide shaft. To achieve the precision required in dependable, high quality inkjet printing, the printing surface is preferred to be uniformly flat across its entire surface to within very small tolerance. Further, the guide shaft and the jet plate are preferred to be parallel relative to the printing surface also to within very small tolerances.

In the prior art, dependable, high quality inkjet printers typically require a metal platen. Metal is preferred in such a situation because of the accuracy to which metals can be cast, extruded or machined to provide the uniform flatness required of the printing area.

Molded plastic platens, although less expensive than metal, tend not to be uniformly flat to within the very tight tolerances preferred in high quality inkjet printing. Plastic printing surfaces may suffer from imperfections in manufacture, bending, and warping. With time or in environments conducive to the warping of plastics, such bending and warping may occur naturally, may be due to a physical trauma, or may be due to a sustained pressure over time. Finally, the need for uniformly flat printing surfaces and the maintenance to within a very tight tolerance of a uniform distance between the printing surface and the print head becomes even more acute in wide-format inkjet printing where even minor imperfections in either the uniform flatness of the printing surface or the parallelism of the moving jet plate become magnified causing distortions and other inaccuracies in the printing output. Thus, plastic platens under such conditions are not useful for dependable, high quality printing.

SUMMARY OF THE INVENTION

The present invention provides a printer that is highly economical and dependable, but still of high quality and precision and having a platen with jet plate that can maintain, to within very tight tolerances, the distance between the jet plate and the printing surface. In one embodiment of the invention, these important advantages are achieved while using a plastic platen. The use of plastic reduces manufacturing costs significantly. Through the use of an additional structural member exerting an upward force against the bottom of the platen, the printing surface of the platen is held to within very tight tolerances. By bending and maintaining the printing surface of the plastic platen over the structural member many of the manufacturing imperfections, warping and other nonuniformities are eliminated. The structural member can be lengthened to provide support for printing surfaces of varying length, even wide-format printing outputs are now available with these dependable, high quality plastic platens.

Advantageously, in one embodiment, an inkjet printer having a plastic platen is provided. In some embodiments the printer accepts paper of at least about 24 inches in width. The plastic platen may have a printing surface which varies in height only about 0.001 inches to about 0.002 inches along the printing surface length. In some embodiments, the plastic platen is installed during manufacture so that it is slightly bent over a structural member so that the printing surface conforms to the top surface of the structural member.

DETAILED DESCRIPTION OF THE PREFERRED EMBODIMENT

Although the invention herein is described in terms of certain embodiments, other embodiments will become apparent to those of ordinary skill in the art in view of the disclosure herein. Accordingly, the present invention is not intended to be limited by the recitation of certain embodiments, but is intended to be defined solely by reference to the appended clams.

Figure 1:
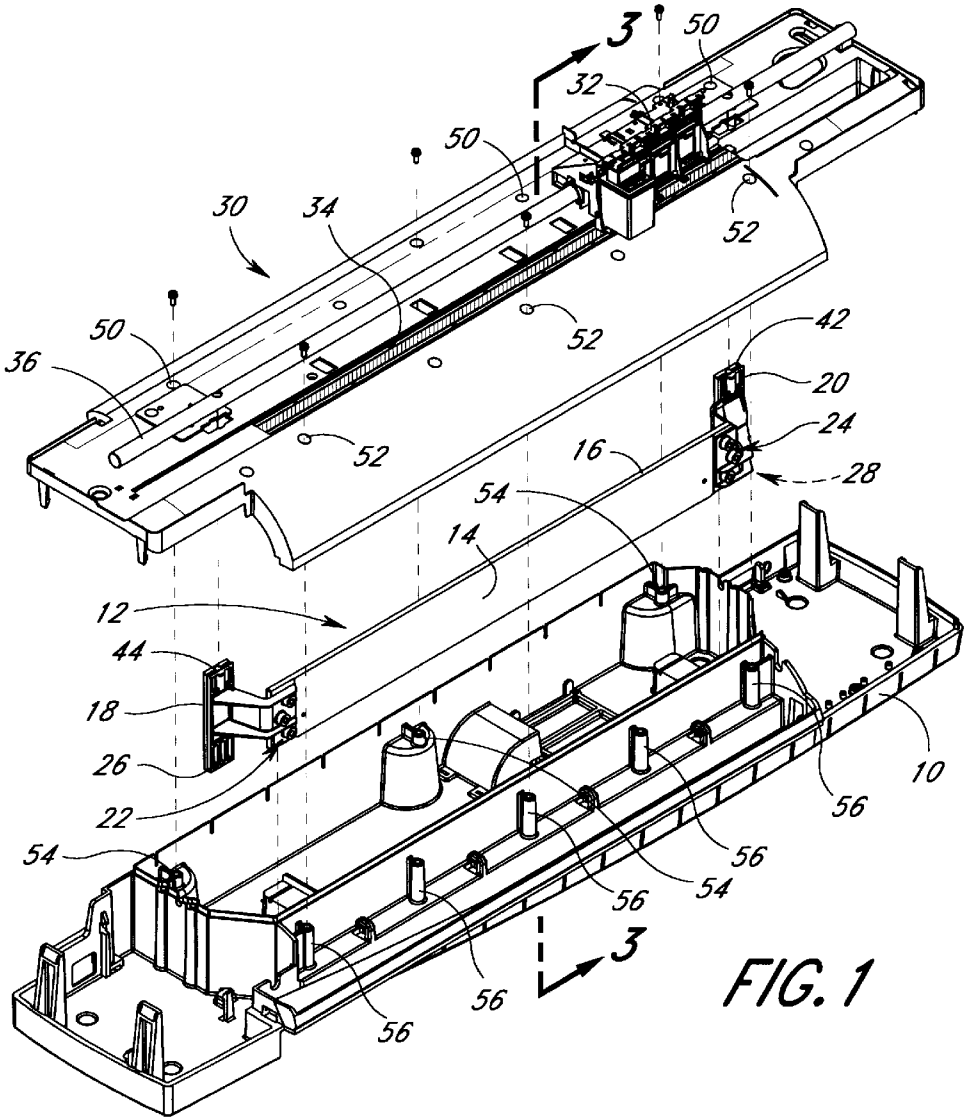
FIG. 1 is an exploded view of one embodiment of a printer according to the present invention.

A printer embodying features of the present invention is illustrated in FIG. 1. The present invention finds especially advantageous application to ink jet printers, as is illustrated in FIG. 1. However, the printer may be a pen plotter or other type of printer. Referring now to FIG. 1, the inkjet printer of includes a base 10, which may be made of plastic or metal, although plastic, such as a type Noryl FN-215X (TM) from General Electric, is generally more cost effective and is quite suitable. As is typical, the plastic base includes areas for mounting power supplies, printed circuit: boards, and other conventional internal parts of inkjet printers well known to those of skill in the art which are not illustrated in the Figures.

Covering the base 10 is a platen 30 which is preferably made of a thin sheet of plastic material, e.g. about 3 millimeters (about ⅛ inch) thick. A polyester, such as Valox (TM) from General Electric, is advantageous for inkjet printers because of its chemical resistance to inks. The platen 30 is sized to fit over the base 10. Typically, the overall width of printers constructed in accordance with this invention varies from less than about 18 inches to more than about 60 inches or more, depending on the size paper the printer is designed to accept. In some embodiments such as wide-format printers, the overall printer width is about 24 inches, about 36 inches, about 42 inches, about 50 inches, about 54 inches, or about 60 inches. The printer illustrated in FIG. 1, for example, will print on D size media sheets. These widths are merely examples of the widths of some embodiments and should not be construed as an exhaustive list or as limiting the invention in any way.

The platen 30 forms the surface on which the substrate to be printed on, typically a sheet of paper, rests while the printing process is taking place. Advantageously, the plastic base and platen 30 form a vacuum chamber to hold the paper to the platen during the printing process. To print on a two-dimensional surface, a print carriage 32, which provides mounts for inkjet cartridges (only one of which is illustrated in FIG. 1) moves back and forth in one dimension across the substrate, while the paper advances from the back to the front of the printer. In some printers, as illustrated in FIG. 1, the print carriage 32 is mounted on a metal guide shaft 36 which runs along and above the top surface of the platen. A relatively narrow strip 34 running along the width of the platen 30 directly under which the inkjet cartridges pass during the printing process is often referred to as the platen "printing surface". It is advantageous for high quality printing for this printing surface 34 to be flat to a tight tolerance so that as the inkjet cartridges pass over and along the printing surface 34, the distance between the jet plates on the cartridges and the printing surface is maintained to within a tolerance of about 0.010 inches. However, current plastic molding techniques cannot form a plastic platen 30 having a printing surface with the flatness required for high quality inkjet printing.

A significant feature of this invention is that, as shown in the Figures, resting in the base 10 is a structural member 12. The structural member 12 comprises an approximately vertically situated plate 14. In one embodiment of the present invention, the structural member 12 is sandwiched between the base 10 and the plastic platen 30 so that support for the printing surface is provided, and the required flatness of the printing surface may be achieved. This plate 14 may be made of metal or suitably rigid plastic. Aluminum has been found suitable in many specific embodiments. In some embodiments, the width of the plate 14 is selected to extend approximately the entire width of the printing surface of the inkjet printer. By way of specific example, a plate 14 suitable for use in a D-size printer as shown in FIG. 1 measures about 2.75 inches wide by about 25.3 inches long by about 0.25 inches thick, and is illustrated in more detail in FIG. 2. The top surface 16 of the plate 14 is preferably machined to be approximately flat to within a tight tolerance generally less than about 0.005 inches, or more preferably less than about 0.002 inches. In some preferred embodiments, the top surface is approximately flat to within about 0.001 inches.

Figure 3:
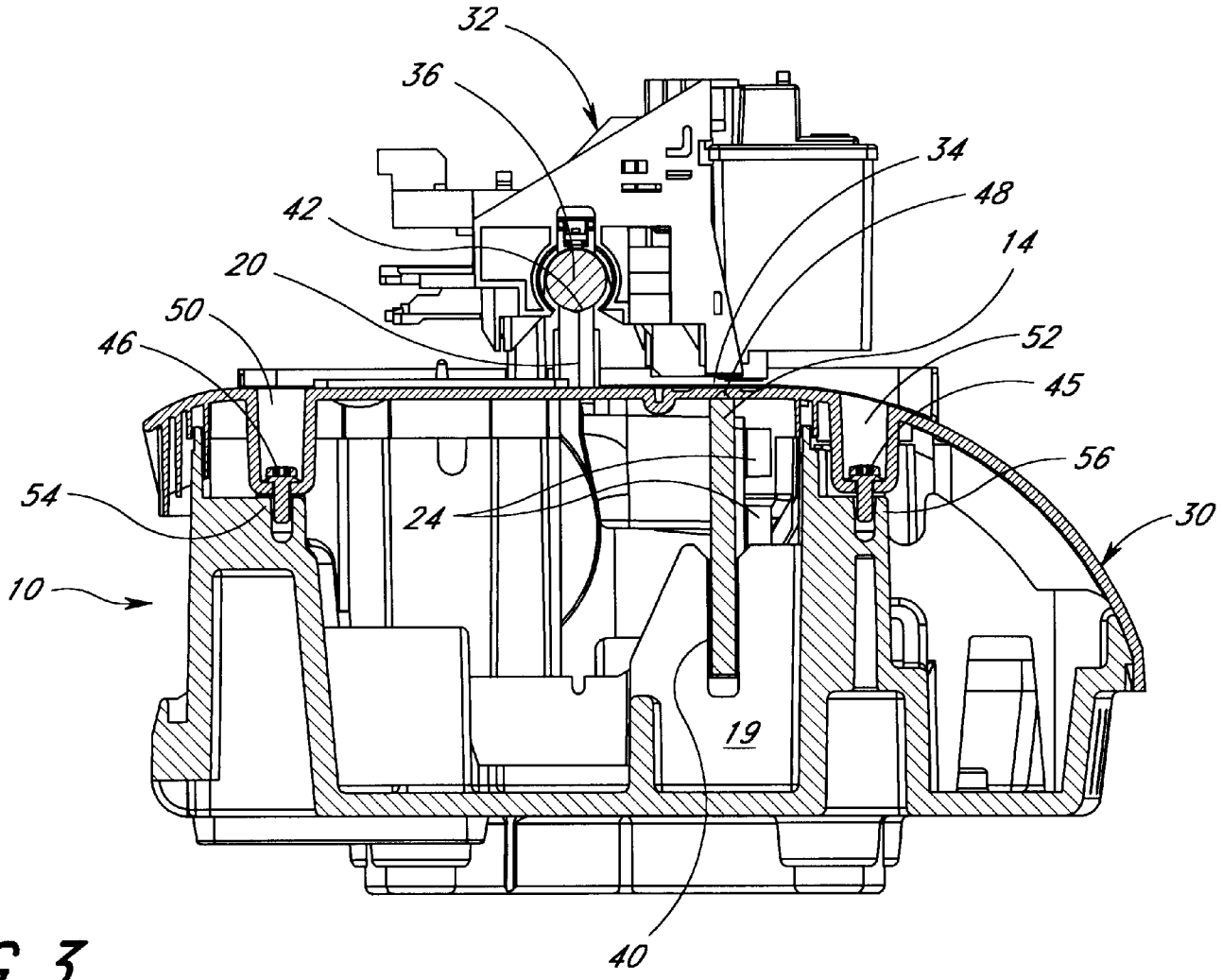
FIG. 3 side view along lines 3—3 of the printer of FIG. 1.

The structural member 12 rests in the base 10 of the printer, with the bottom of the plate 14 resting on two platforms 15*a,* 15*b* within the base 10 positioned near the opposite ends of the plate 14. As shown in FIG. 3, the plate 14 rests in slots 40 which are provided in the platforms 15*a,* 15*b* and which may also be included in one or more centrally located ribs 19 (one of which can be seen in FIG. 3) which are molded as part of the base 10. The slots in the centrally located ribs 19 are deeper than the slots in the platforms 15*a,* 15*b.* Thus, the plate 14 rests at the base of the slots provided in the platforms 15*a,* 15*b,* but does not reach the bottom of the slots 40 in the centrally located rib or ribs 19. The slots 40 and platforms help position the plate 14 in its correct location beneath the printing surface 34. Careful positioning of the plate 14 is important because plate position determines the position of the guide shaft 36 relative to the printing surface 34. Many different methods may be used to accomplish this. For example, shims may be placed in the slots 40 during assembly to accurately position the guide shaft 36 relative to the printing surface 34. Alternatively, a resilient biasing member (not shown) can be secured to the base which contacts the plate and biases it towards one side of the slots 40.

Figure 2:
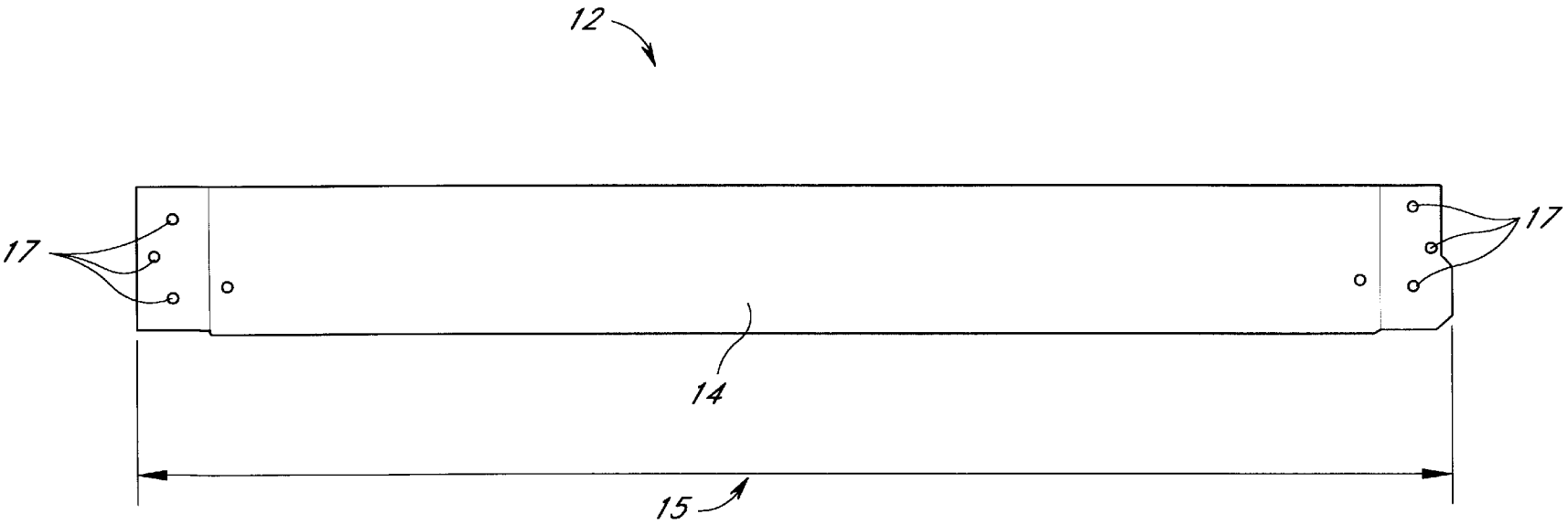
FIG. 2 ne embodiment of the structural member of FIG. 1.

FIG. 2 displays one specific embodiment of the plate 14. In this embodiment, an aluminum plate 14 suitable for a printer designed for about 24 inch wide paper is shown. The aluminum plate 14 has a length 15 of about 25.3 inches and a thickness of about 0.25 inches. The aluminum plate 14 also has threaded through holes 17 for securing the brackets 18 and 20. The plate 14 is secured at each end to a left bracket 18 and a right bracket 20 with bolts 22 and 24 and threaded. through-holes in the plate 14. As with the plate 14, the brackets 18 and 20 may be made from metal or rigid plastic, and may advantageously be molded or machined as a single monolithic piece of material. In these embodiments, the bottom surfaces of the brackets 26 and 28 do not contact the base 10.

As is seen in both FIG. 1 and FIG. 3, the right side of the plate 14 is secured with bolts 24 to a bracket 20 described above. Of course, the same is true on the left side of the plate 14 as well, but it is not visible in the cutaway view of FIG. 3. As described above, the bottom surface of the plate 14 rests on platforms. The top surface 42 of the bracket 20 is contoured to accept the guide shaft 36. It can be appreciated that the top surface 44 of the left bracket 18 is similarly contoured. The guide shaft 36 is screwed down to the brackets 18 and 20 at each side. The guide shaft 36 thus runs above and parallel to the printing surface 34, so that the attached carriage 32 passes back and forth across the printing surface during the printing process.

The platen 30 may be secured to the base 10 with a set of front screws and a set of rear screws. One front screw is illustrated at 45 and one rear screw is, illustrated at 46 in FIG. 3. The platen 30 is positioned relative to the plate 14 such that the printing surface 34 is directly above the top surface 16 (shown in FIG. 1 is of the plate 14. In the embodiment shown, the width of plate 14 is such that the top surface 16 of the plate 14 extends slightly higher above the bottom of base 10 than the bottom surface of the platen 30 would rest in its natural state if it were screwed down in place in the absence of the plate 14. As a result, in this embodiment, when the platen 30 is attached to the base 10, the top surface 16 of the plate 14 exerts an upward force on the bottom of the platen 30 directly beneath the printing surface 34. In these embodiments, when the platen 30 is assembled with the base 10, the plastic material of the platen 30 is actually slightly bent as it passes over the plate 14, with the bend running the length of the printing surface 34.

In some embodiments, a groove may be located at 48 (FIG. 3) in the bottom surface of the platen 30 which runs the length of the printing surface 34, and thus rests on the top surface 16 of the plate 14 when the printer is assembled. This groove 48 provides a linearly extending weakness in the platen 30 material that ensures that the bend in the platen produced by the plate 14 is properly positioned along the printing surface 34. The groove 48 can be many different shapes and depths, with triangular cross sections having been found suitable. The depth of the groove may also vary widely. A depth of about one-third of the material thickness has been found to be advantageous. By way of specific example, with an about 1 millimeter deep groove may be provided in an about 3 millimeter thick platen 30.

It can be appreciated that the linearly extending bend forces the thin plastic material of the platen to conform very closely to the upper surface 16 of the plate 14 along the bend. Even if the molded platen 30 material has warps or other manufacturing imperfections prior to being positioned as shown in FIG. 3, these imperfections are removed along the printing surface by the presence of the bend and the support provided by the plate 14. It is thus possible to produce a wide format inkjet printer with a plastic platen that has a printing surface 34 with a flatness that does not deviate more than about 0.001 inches to about 0.002 inches up or down, and which maintains the jet plate to platen distance to a tolerance of within about ±0.010 inches.

Those of skill in the art will appreciate that it is important for quality printing that the height of the cartridge jet plates above the printing surface 34 be within about ±0.01 inches from their nominal position. Deviations from the nominal value may arise for several reasons. One reason is warping of the platen itself. This problem is addressed with the platen bend as described above. Other factors include variations in the platen thickness, as well as curving or misalignment of the guide shaft 36 relative to the printing surface 34. Accordingly, the platen 30 thickness is preferably held to a tolerance of within about 0.001 to about 0.002 inches at least in the region of the printing surface 34. In addition, each structural member 12 is machined and assembled with care to ensure not only that the top surface 16 of the plate 14 is flat, but also that the height of the tops 42 and 44 of the brackets 20 and 18 conform closely to the height required to produce the desired jet plate-substrate distance, and to maintain parallelism between the top surface 16 of the plate 14 and the axis of the guide shaft 36. Thus, the brackets 18 and 20 are carefully aligned so that when the guide shaft 36 is secured to them, it follows the printing surface without shifting relative to the printing surface 34 as it extends from one bracket to the other.

Preferably the structural member 12 is assembled on a jig which rigidly fixes the brackets and the plate in their appropriate relative locations prior to their being bolted together. The structural member 12 is thus bolted together so as to maintain parallelism between the guide shaft 36 and print surface 34 so as to conform to the desired final configuration within the required tolerances. Although assembly of the structural member must be performed with care, meeting the tolerances required for high quality printing is within the ordinary skill in the art. In fact, because only the relative distance between two points, namely, the top surface 16 of the plate 14 and the tops 42 and 44 of the brackets 20 and 18, is significant, the time and effort required to produce a printer having a properly positioned guide shaft 36 and printing surface 34 is much less than has been required prior to the present invention.

To assemble the printer of FIGS. 1 and 3, the structural member 12 is placed in the base 10, and is biased in the slots 40 with shims or with another biasing device in the base 10. The bottom surface of the platen under the printing surface 34 is then placed on the top surface 16 of the plate 14. Following this placement, it can be preferable for the bottom surface of the platen 30 at the screw wells 50 and 52 to not reach the top surfaces of the front screw bosses 56 of the base 10. It has been found suitable for the platen 30 to be configured so that when it rests in its natural state with the printing surface 34 resting on the top surface 16 of the plate 14, the bottom of the rear screw wells 50 just reaches the top of the rear screw bosses 54, and the bottom of the front screw wells 52 is about 1 millimeter above the top of the front screw bosses 56. When the screws are tightened, the platen 30 bends slightly over the plate 14 as described above, to produce the flat printing surface.

The foregoing description details certain preferred embodiments of the present invention and describes the best mode contemplated. By way of example, in another embodiment of the invention (not shown) the structural member 12 is actually part of the base 10. In such an embodiment, the structural member 12 and the base 10 are both made of the same material, such as metal or plastic, and are made from the same mold with the structural member 12 extending upward from the base 10. It will be appreciated, however, that no matter how detailed the foregoing appears in text, the invention can be practiced in many ways. As is also stated above, it should be noted that the use of particular terminology when describing certain features or aspects of the present invention should not be taken to imply that the broadest reasonable meaning of such terminology is not intended, or that the terminology is being re-defined herein to be restricted to including any specific characteristics of the features or aspects of the invention with which that terminology is associated. The scope ol the present invention should therefore be construed in accordance with the appended claims and any equivalents thereof.

What is claimed is:

1. A inkjet printer having reduced manufacturing cost while maintaining, to within very tight tolerances, the distance between the jet plate and the printing surface, comprising:

a base;

a structural member resting on said base, said structural member comprising a rigid plate having a top surface; and a plastic platen providing said printing surface below said jet plate, said plastic platen being supported by said structural member wherein said top surface of said rigid plate is positioned along said printing surface and wherein the printing surface of plastic platen is held to said very tight tolerances by said top surface of said rigid plate whereby said printing surface is retained in an approximately flat configuration so as to minimize inaccuracies in drop deposition from said jet plate during the ink jet printing process.

2. A printer comprising:

a platen including a printing surface, wherein said printing surface is within about 0.002 inches of a nominal thickness at least in the approximate region of said printing surface;

a structural member supporting said platen along at least a portion of said printing surface; and a base supporting said structural member.

3. The printer of claim 2, wherein said structural member comprises a metal plate, wherein said metal plate has a top surface aligned along and underneath said printing surface.

4. The printer of claim 3, wherein said platen is bent over said top surface of said metal plate.

5. The printer of claim 3, wherein said top surface of said metal plate is approximately flat to within a tolerance of less than about 0.005 inches.

6. The printer of claim 3, wherein said top surface of said metal plate has a width approximately equal to the width of said printing surface.

7. The printer of claim 3, wherein said top surface of said metal plate extends slightly higher than the position of said printing surface when said platen is attached to said base without said structural member.

8. The printer of claim 3, wherein said plate is mounted on said base, said plate extending approximately vertically from said base.

9. The printer of claim 3, wherein said metal plate comprises aluminum.

10. The printer of claim 3, wherein said top surface of said metal plate exerts an upward force on said platen.

11. The printer of claim 10, wherein said upward force causes said platen to conform approximately to said top surface of said metal plate.

12. The printer of claim 3, wherein said base comprises platforms with slots, wherein said metal plate rests in said slots so as to be aligned with said printing surface.

13. The printer of claim 2, wherein said platen has at least one groove under said printing surface.

14. The printer of claim 13, wherein said groove has an approximately triangular cross section.

15. The printer of claim 13, wherein said groove has a depth about one-third of the thickness of the platen.

16. The printer of claim 2, wherein said structural member is integrally molded with said base.

17. A printer comprising:

a platen including a printing surface;

a structural member supporting said platen;

brackets having top surfaces, wherein said brackets are coupled to said structural member; and a guide shaft secured to said top surfaces of said brackets, wherein said top surfaces of said brackets are contoured to accept said guide shaft and wherein said guide shaft is positioned approximately parallel to said printing surface.

18. A printer comprising:

a platen which comprises a printing surface and a groove running along said printing surface, and means for bending said platen along said groove to produce an approximately flat printing surface.

19. A method of constructing a printer comprising:

securing a structural member with a top surface to a base of said printer;

positioning a platen over said structural member of said printer, wherein said platen has a printing surface and wherein said printing surface is proximate said structural member, and forcing said platen over said structural member so that said printing surface substantially conforms to a contour of said top surface of said structural member.

20. A plastic platen for an ink jet printer, said plastic platen comprising:

a top side comprising a printing surface;

a bottom side opposite said printing surface, wherein said bottom side comprises a groove having a depth of about one-third of the thickness of the platen running along at least a portion of said printing surface.

21. The platen of claim 20, wherein said groove has an approximately triangular cross section.

22. A printer comprising:

a platen including a printing surface;

a structural member supporting said platen along at least a portion of said printing surface; and a base supporting said structural member, wherein said base is integrally molded with said structural member.

23. A printer comprising:

a platen including a printing surface and having at least one groove situated under said printing surface;

a structural member supporting said platen along at least a portion of said printing surface; and a base supporting said structural member.

24. A printer comprising:

a platen including a printing surface;

a structural member having a top surface aligned along and underneath said printing surface thereby supporting said platen along at least a portion of said printing surface, wherein said structural member is approximately flat to within a tolerance of less than about 0.005 inches; and a base supporting said structural member.

25. A printer comprising:

a platen including a printing surface;

a structural member having a top surface aligned along and underneath said printing surface thereby supporting said platen along at least a portion of said printing surface; and a base comprising platforms with slots, wherein said structural member rests in said slots so as to be supported by said base and aligned with said printing surface.

26. A printer comprising:

a platen including a printing surface;

a structural member having a top surface aligned along and underneath said printing surface thereby supporting said platen along at least a portion of said printing surface by exerting an upward force on said platen and causing said platen to conform to said top surface of said structural member; and a base supporting said structural member.

27. A printer comprising:

a base;

a platen including a printing surface, wherein said platen is mountable to said base;

a structural member having a top surface aligned along and underneath said printing surface thereby supporting said platen along at least a portion of said printing surface, wherein said top surface of said structural member extends slightly higher than the position of said printing surface when said platen is attached to said base without said structural member.

* * * * *